US005150649A

United States Patent [19]

Kumaki et al.

[11] Patent Number: 5,150,649

[45] Date of Patent: Sep. 29, 1992

[54] INK POT DEVICE FOR PRINTING MACHINE

[75] Inventors: Tuneo Kumaki; Toshikatu Nagase, both of Omiya; Yasuhisa Shichijo, Saitama, all of Japan

[73] Assignee: JPE Co., Ltd., Saita Ma Ken, Japan

[21] Appl. No.: 639,752

[22] Filed: Jan. 11, 1991

Related U.S. Application Data

[63] Continuation of Ser. No. 363,281, Jun. 6, 1989, abandoned, which is a continuation-in-part of Ser. No. 92,237, Sep. 2, 1987, abandoned.

[30] Foreign Application Priority Data

| | | | |
|---|---|---|---|
| Sep. 11, 1986 | [JP] | Japan | 61-214259 |
| Sep. 11, 1986 | [JP] | Japan | 61-214261 |
| Sep. 12, 1986 | [JP] | Japan | 61-140481[U] |
| Sep. 12, 1986 | [JP] | Japan | 61-269333 |
| Mar. 26, 1987 | [JP] | Japan | 62-44936[U] |

[51] Int. Cl.[5] ..... B41F 31/04; B41F 31/06; B41F 27/06

[52] U.S. Cl. ..... 101/365; 101/DIG. 47

[58] Field of Search ..... 101/365, 350, 157, 169, 101/363, 364, 207–210, 148, DIG. 47; 118/261; 15/256.5

[56] References Cited

U.S. PATENT DOCUMENTS 4,372,207 2/1983 Toyoda ..... 101/365

FOREIGN PATENT DOCUMENTS 0179350 10/1984 Japan ..... 101/365

*Primary Examiner*—J. Reed Fisher

[57] ABSTRACT

An ink pot device for an offset printing machine, comprising a fulcrum holder and an adjust piece that move back and forth, a link that is arranged between inner ends of said adjust piece and said fulcrum holder and eccentric cam that is equipped in the upper part of said link, in which ink keys are driven forwardly and backwardly to finely adjust the supply rates of ink, and An ink pot device for an offset printing machine, comprising manual rotation knobs that are attached to a back/forth movable fulcrum holder and an adjust piece, in which ink keys are driven forwardly and backwardly to adjust the supply rates of ink, and An ink pot device for a printing machine, comprising a stepping motor or a synchronous motor for driving said adjust piece, in which ink keys are driven forwardly and backwardly to adjust the supply rates of ink, and An ink pot device for a printing machine, comprising engagement protrusion that are equipped on both side of a motor driving force transmission gear in such a manner as engageable with an outer stopper protrusion, in which ink keys are driven forwardly and backwardly to adjust the supply rates of ink.

9 Claims, 10 Drawing Sheets

INK POT DEVICE FOR PRINTING MACHINE

This is a continuation of co-pending application Ser. No. 363,281 filed on Jun. 6, 1989, now abandoned, which was a continuation-in-part of application Ser. No. 092,237 filed Sep. 2, 1987, now abandoned.

BACKGROUND OF THE INVENTION

1. Field of the Invention

The present invention relates to an ink pot device for the printing machine in the offset printing system, more particularly to an improvement of the ink pot device for the offset printing machine, in which the supply rate of ink is decreased or increased by driving a plurality of ink keys that are arranged in due order, individually forwardly or backwardly.

2. Prior Art

In the prior art, this type of ink pot device requires such skills to move the ink keys for controlling inking rates that the device can be operated only by those skilled in the art for long time. However, other devices in the printing system are operable without requiring such a degree of skills. Therefore, it is demanded to develop an ink pot device for the offset printing machine, in which even an unskilled operator can simply and easily adjust the strokes of the ink keys.

When inking rates are adjusted manually by moving the ink key, it is preferred that the operation can simply and precisely be conducted in higher work efficiency.

Another aspect of the present invention relates to such an ink pot device for the printing machine that inking rates for printing are adjusted by controlling a stepping motor for adjusting the ink keys through a simple electrical control.

Such a type of ink pot device based on this electrical control known in the prior art is shown in FIG. 3 Electrical circuit diagram in which an ink key adjusting servomotor is provided for each ink key and located according to the ink supply rate data sent from the control panel, while also being controlled by the feedback data sent from the potentiometer for setting the ink keys.

Consequently, a servomotor and a potentiometer must be used for each ink key in the ink key adjusting device where the number of ink keys, servomotors or potentiometers in use is 20–40 for the 1 unit (1 color) system, although depending on the size of printing material, while the number being quadruplicated or hexaplicated for 4-color or 6-color printing. In addition, an expensive servoamplifier is required in the control panel. Therefore, the ink supply control system was much expensive in fact. Furthermore, each servomotor and potentiometer are connected through 2-stage gears, requiring many adjusting positions and large dimensions. Moreover, the servomotor is a DC machine having limited life in the brush as well known in the art. Accordingly, such a system known in the prior art has some disadvantages in view of maintenance, control and reliability for a long time use. Another aspect of the present invention relates to an improved mechanism for controlling the opening of the ink outlet port in the ink pot device for the printing machine.

A system of the ink outlet port opening adjusting mechanism for this type of ink pot device, as known in the prior art, is shown in FIG. 13. According to this system, the upper and lower limits of the adjusting mechanism are obtained by applying a counter force in the direction resistive to the axial movement of driving force transmission gear 57, onto transmission gear 57 by means of a butt type stopper protrusion 63. In consequence, an inner screw and threads in a screw bolt often come in so-called gouged state in driving force transmission gear 57. When shuttling motion of the driving force transmission gear takes place after butting with stopper protrusion 63, gouging causes sluggishness and non-smooth operation. In addition, the driving force transmission gear becomes unstable while slidedly dislocating stop position when butting with stopper protrusions 63. These disadvantages were associated with this type of ink pot device known in the prior art.

SUMMARY OF THE INVENTION

One object of the present invention is to provide an improved ink pot device for the offset printing machine, in which a plurality of arranged ink keys is individually driven forward or backward to reduce or increase the supply rates of ink. Such a device, according to the present invention, comprises:

A fulcrum holder that can move forwardly and backwardly in inward/outward direction, An adjust piece that is located under said fulcrum holder and can move forwardly and backwardly in inward/outward direction, A link that is arranged crossingly in inward/outward direction between the inner ends of these adjust piece and fulcrum holder with a bearing end being supported by the fulcrum axis at the inner end of said fulcrum holder in a freely vibrating manner while a free end being pressure contacted to the inner end of said adjust piece by means of a guide bush, etc., An eccentric cam that is equipped integratedly in the upper part of said link with its center located at a point slightly offset from the center of the fulcrum axis and A second floating ring that is bearingly supported at the upper end of the link through said eccentric cam.

With this ink pot device for the offset printing machine, according to the present invention, the strokes of the ink keys are finely adjusted according to the cam operation of the second floating ring that moves by the swinging of the ring caused by forward or backward movement of the adjust piece and the shifting of fulcrum point of the link associated with the forward or backward shifting of the fulcrum holder.

Another object of the present invention is to provide a manual ink pot device for the offset printing machine, in which a plurality of arranged ink keys is individually driven forwardly or backwardly thereby decreasing or increasing the supply rates of ink, comprising:

A fulcrum holder that moves forwardly and backwardly in inward/outward direction, An adjust piece that is equipped under said fulcrum holder and moves forwardly and backwardly in inward/outward direction, A link that is arranged crossingly in inward/outward direction between the inner ends of these adjust piece and fulcrum holder with its bearing end being supported by the fulcrum axis at the inner end of said fulcrum holder in a freely vibrating manner while a free end being pressure contacted to the inner end of said adjust piece by means of a guide bush, etc., An eccentric cam that is equipped integratedly in the upper part of said link with a center located at a point slightly offset from the center of the fulcrum axis and A second floating ring that is bearingly supported at the upper end of the link through said eccentric cam, A pushing means that always pushes the rear end of the ink key onto the cam surface of said eccentric cam, A zero point adjusting screw shaft device that is provided with a manual rotation knob for driving the fulcrum holder to move forwardly and backwardly and A fine adjusting screw shaft device that is provided with a manual rotation knob with a counter, that drives the adjust piece to move forwardly and backwardly.

Still another object of this invention is to present an ink pot device for the printing machine, in which a plurality of arranged ink keys is individually driven forwardly or backwardly to decrease or increase the supply rates of ink, comprising:

A stepping motor equipped for each ink key, that is controlled in a closed loop and provided with a coaxially arranged rotary encoder as a forward/backward driving device for the ink key.

Another object of the present invention is to offer an ink pot device for the printing machine, in which a plurality of arranged ink keys is individually driven forwardly or backwardly to decrease or increase the supply rates of ink in the offset printing machine, comprising:

A stepping motor that is provided for each ink key as an ink key forward/backward driving device.

Still another object of this invention is to provide an ink pot device for the printing machine, in which a plurality of arranged ink keys is individually driven forwardly or backwardly to decrease or increase the supply rates of ink for the manual ink pot device in the offset printing machine, comprising:

A synchronous motor that is provided for each ink key as an ink key forward/backward driving device.

Still another object of the present invention is to offer an ink pot device for the printing machine, in which a plurality of arranged ink keys is individually driven forwardly or backwardly to decrease or increase the supply rates of ink for the ink pot device of the printing machine, comprising:

A fulcrum holder that moves forwardly and backwardly in inward/outward direction, An adjust piece that is equipped under said fulcrum holder and moves forwardly and backwardly in inward/outward direction, A link that is arranged crossingly in inward/outward direction between the inner ends of these adjust piece and fulcrum holder with a bearing en being supported by the fulcrum axis at the inner end of said fulcrum holder in a freely vibrating manner while a free end being pressure contacted to the inner end of said adjust piece by means of a guide bush, etc., An eccentric cam that is equipped integratedly in the upper part of said link with a center located at a point slightly offset from the center of the fulcrum axis and A second floating ring that is bearingly supported at the upper end of the link through said eccentric cam and A second floating link, while said adjust piece being moved by a motor for finely adjusting the strokes of the ink keys according to the cam operation of the second floating ring that is dislocated due to the swinging of the link when said adjust piece moves forwardly and backwardly and the movement of the link when the fulcrum holder moves forwardly and backwardly, in said ink pot device, A transmission gear that is supported movably in an axial direction by means of a screw bolt for transmitting the driving force of said motor, an engagement protrusion for upper limit and an engagement protrusion for lower limit that are provided on each side face of said transmission gear, an upper limit stopper protrusion that engages with said engagement protrusion for upper limit and stops said transmission gear when the gear reaches the upper limit position and an lower stopper protrusion that engages with said engagement protrusion for lower limit and stops the gear when the gear reaches the lower limit position.

DETAILS DESCRIPTION AND PREFERRED EMBODIMENTS OF THE INVENTION

Figure 1:
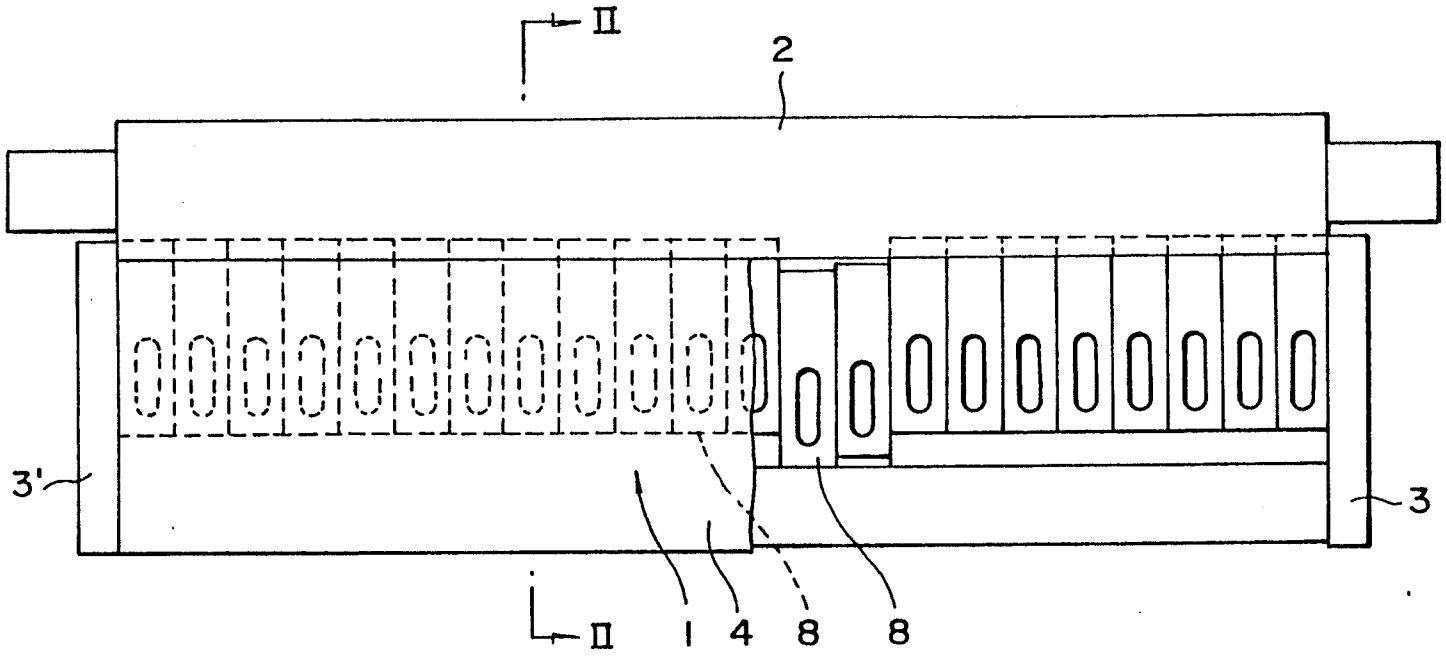
FIG. 1 shows a partial cutaway plan view for the entire assembly of an ink pot device of the offset printing machine according to the present invention.

This invention will be described in detail referring to the drawings, by which the present invention will be understood more exactly. Needless to say, however, this invention is not limited by these embodiments but can be modified in various ways as long as the scope of the principles of the invention is not exceeded. In these drawings, the same or substantially the same elements are symbolized by the same number.

Figure 2:
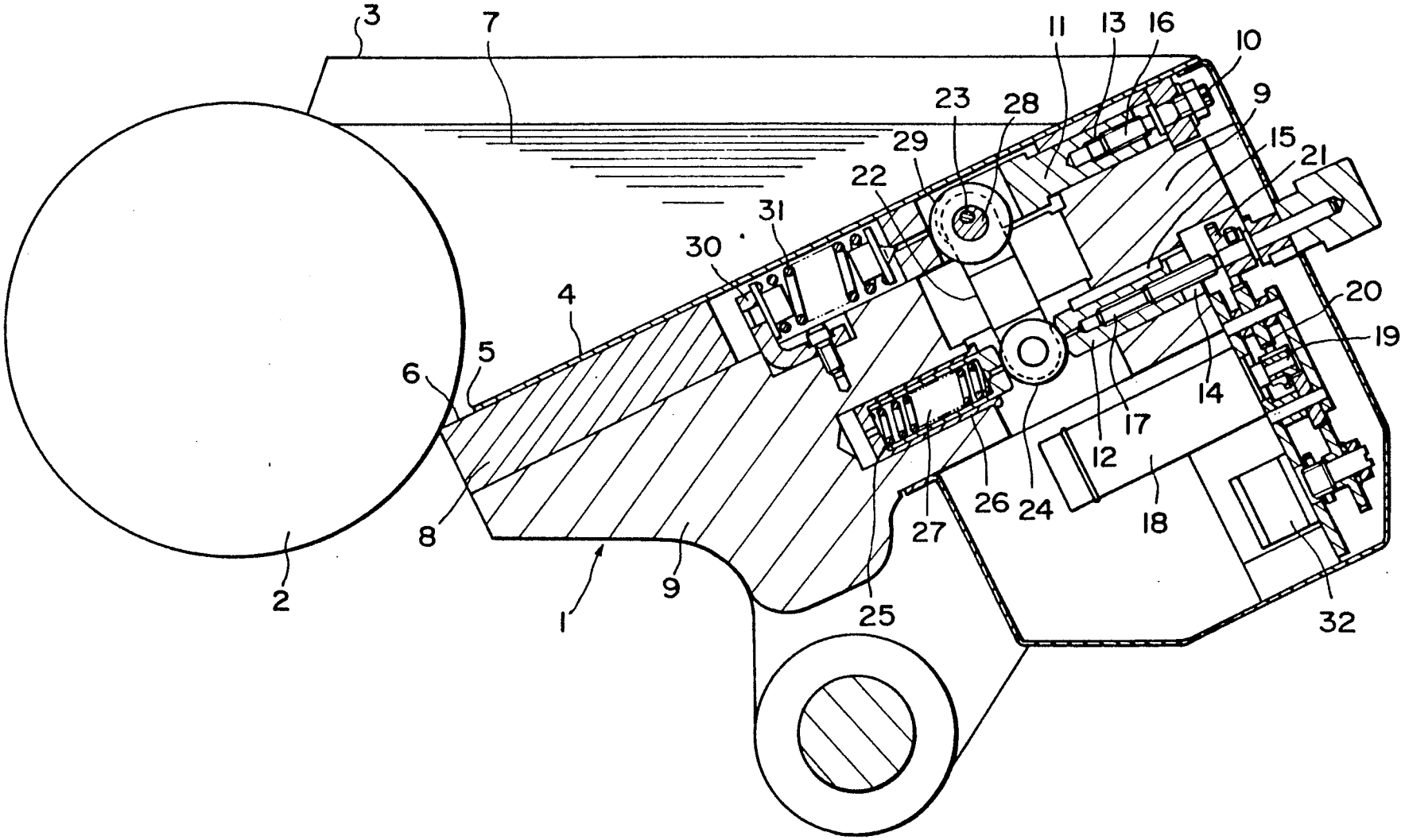
FIG. 2 is a sectional drawing along line II—II of FIG. 1.
Figure 3:
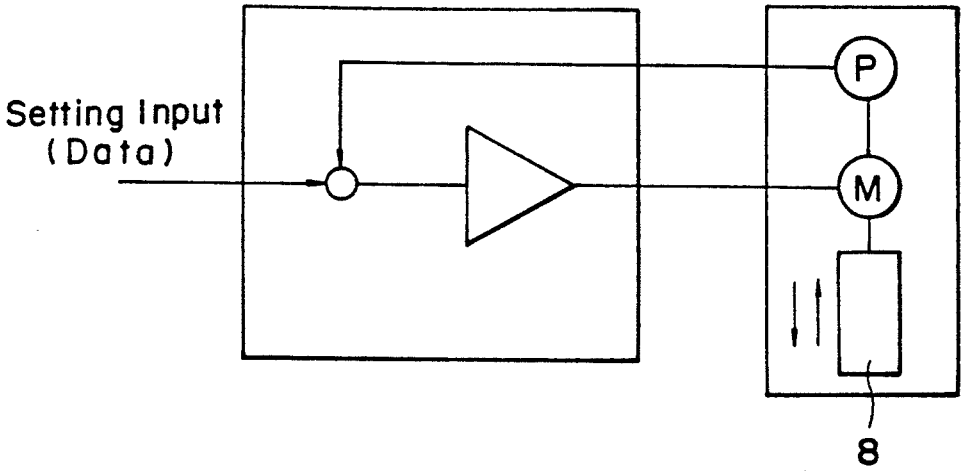
FIG. 3 illustrates the electrical circuit diagram of the ink pot device embodied as shown in FIGS. 1 and 2.

FIG. 1 is a partial cutaway plan view for showing the entire assembly of the ink pot device for the offset printing machine according to the present invention. FIG. 2 shows a sectional view of the line II—II in FIG. 1.

This ink pot device is enclosed by ink gate roller 2 at its front side of device body 1, a pair of ink dams 3, 3' at both left and right sides and sloped bottom plate 4 at its rear and bottom face. On device body 1, there is a funnel ink pot 7 provided with an ink outlet slit 6 between front fringe 5 of said bottom plate 4 and the outer face of ink gate roller 2. Said device body 1 is provided with a plurality of ink keys 8 whose tops cross the lower face of said ink outlet slit 6 in such a manner as closely located to front fringe 5 of bottom plate 4 while being located closely to or in contact with the outer face of ink gate roller 2, and a board 9 that sandwiches these ink keys 8 in a closely located and contactly operable manner.

Device body 1 is provided with a fulcrum holder 11 that moves forwardly and backwardly in the rear part of each ink key 8, and an adjust piece 10 that also moves forwardly and backwardly in the lower part of the ink keys.

Fulcrum holder 11 is housed in a guide hole 13 drilled in device body 1 in a rotatable and forwardly/backwardly movable manner while adjust piece 12 being enclosed in guide hole 14 drilled in device body 1 in a forwardly/backwardly movable manner. Adjust piece 12 is not rotatable because of a key 15.

A zero point adjusting screw shaft 16 is screwed in into the rear part of fulcrum holder 11, for moving forwardly/backwardly fulcrum holder 11.

A fine adjusting screw shaft 17 is also screwed in adjust piece 12 for forward/backward movement. This fine adjusting screw shaft is rotated by motor 18 through gears 19, 29 and 21, thereby adjust piece 12 moves forwardly and backwardly.

A link 22 is mounted in the up/down direction at the front edge of these fulcrum holder 11 and adjust piece 12. The fixed end of said link 22 is pivotedly supported by fulcrum axis 23 onto fulcrum holder 11 in a manner of free swinging in back/forth direction. The rear face of the floating end of link 22 is always in contact with the front end of adjust piece 12 through a first floating ring 24, pressurizingly by means of a pusher 27 comprising a spring 25 and a guide bush 26.

An eccentric cam 28 is integratedly equipped in the upper part of link 22, at center point slightly eccentric from the center of said fulcrum axis 23. A second floating ring 29 is engaged on the outer periphery of the cam face of eccentric cam 28. A spring 31 is placed in the rear part of ink key 8 through spring seat 30. The rear end of ink key 8 is normally in contact with second floating ring 29 by the force of said spring 31.

Figure 5:
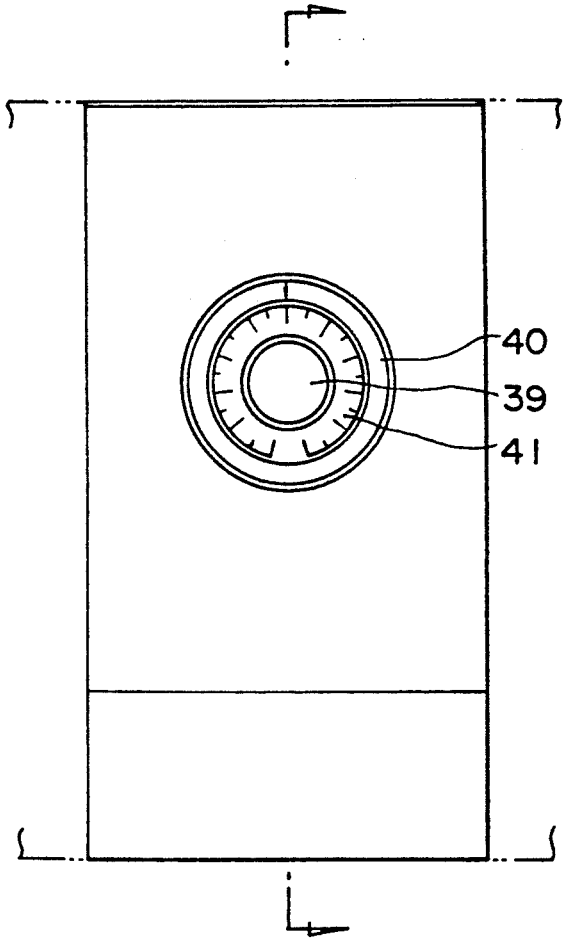
FIG. 5 is an enlarged front view of the dial knob with the embodiment shown in FIG. 4.
Figure 7:
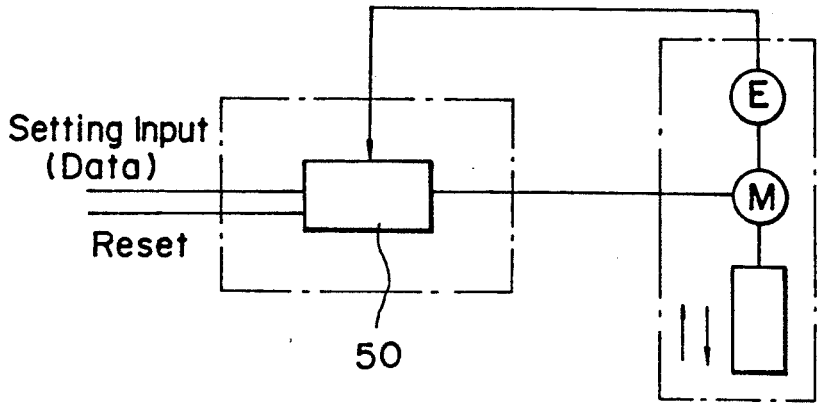
FIG. 7 shows the electrical circuit diagram for an ink pot device using the servomotors according to the prior art.

For moving ink keys 8 of this device, adjust piece 12 is moved forwardly and backwardly by means of motor 18. Then first floating ring 24 is moved forwardly and backwardly while slightly moving forwardly/backwardly second floating ring 29 through the swing of link 22. In the result, ink keys 8 are driven back/forth. Therefore, ink keys 8 are mainly adjusted by operating motor 18. Then motor rotation is transmitted to potentiometer 32 through the gears. As soon as the open/close conditions of ink keys 8 (for example, the resistance becomes 0% in complete complete closure and 100% in complete opening) are noted, the change of this resistance is fed back to automatically control the opening/closing of ink keys 8. FIG. 5 shows the electrical circuit diagram of this embodiment.

Therefore, it is important to check an agreement between the electrical zero point of potentiometer 32 (resistance 0%) and the mechanical zero point (for example, where the ink key is in complete contact with the roller) before first starting operation or beginning it after a long time operation or rest. If not in agreement, zero point adjustment is required to achieve complete agreement.

With a device known in the prior art, the angle of engagement between the potentiometer and the coupling gear must be changed and adjusted at that time. In the extreme, the gear must be removed. Each key, among scores of those arranged in a row, must be finely adjusted, which required high skills and long adjusting time, much inconvenient for continued operation.

Where the ink pot device of the present invention is used, however, ink keys 8 can be finely moved in inward/outward direction independently from the adjustment of potentiometer 32, by operating zero point adjusting screw shaft 16 of fulcrum holder 11 in back/forth direction. Therefore, even an unskilled operator can adjust this zero point while spending much shorter time for the adjustment, more conveniently and efficiently.

The following advantages can be obtained by making larger the ratio of the stroke of ink keys 8 to the stroke of adjust piece 12 when ink keys 8 are moved in the inward/outward direction by means of link 22.

(1) Pitch errors of fine adjusting screw shaft 17 are reduced.

(2) Spring 31 should be made stronger to ensure the return motion of ink keys 8 (movement to the outside).

However, with a device according to the prior art, it becomes difficult to employ the spring of satisfactory strength because, where spring force directly applies to fine adjusting screw shaft 17, the screw is greatly thrusted resulting in larger driving torque of the screw and greater burden to motor 18. According to the present invention, on the other hand, the force of return spring 31 for ink keys 8 can be made large enough because the force applied to ink keys 8 is reduced and transmitted to the motor by increasing the ratio of the distance between fulcrum axis 23 and first floating ring 24 to the distance between axis 23 and second floating ring 29. On the contrary, even the motor of a smaller capacity can give a larger force to ink keys 8. Therefore, inward/outward movement of ink keys 8 can be operated surely and easily.

Figure 4:
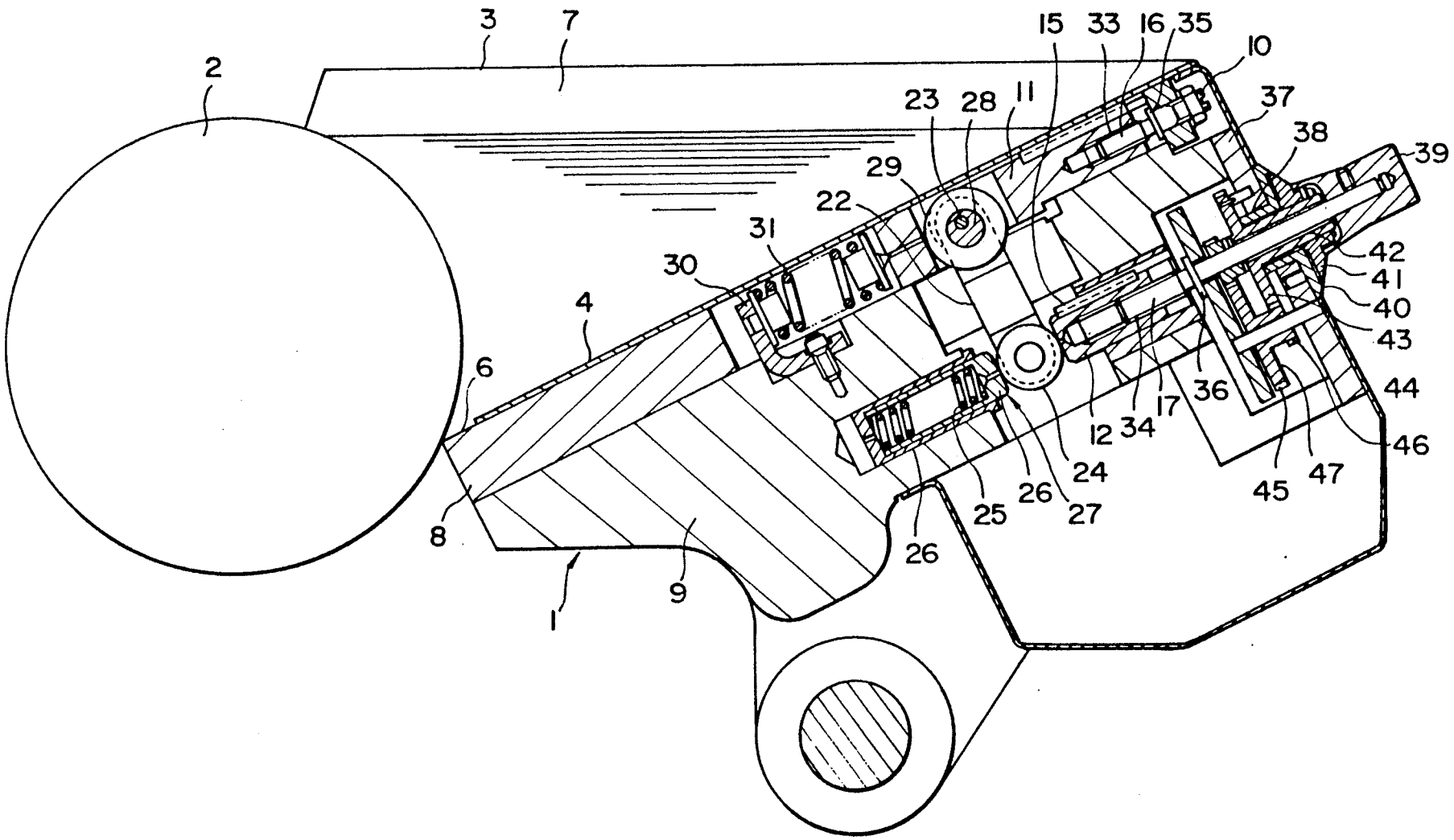
FIG. 4 shows another embodiment of the present invention, like FIG. 2.

FIG. 4 shows the second embodiment of the present invention, like FIG. 2. FIG. 5 illustrates the manual rotation knob of the ink key device shown in FIG. 4.

FIG. 4 shows a similar basic configuration to FIG. 2, including fulcrum holder 11, adjust piece 12, link 22, ink keys 8 and other individual or mutual structures, which are not described in regard to this FIG. 4.

However, the ink key device of the embodiment shown in this FIG. 4 is different from the embodiment of FIG. 2 in that a manual operation knob 38 is equipped in the rear part of the adjust piece.

More explicitly, female screws 33, 34 are threaded in the rear ends of fulcrum holder 11 and adjust piece 12, to which zero point adjusting screw shaft 16 and fine adjusting screw shaft are engaged at there front ends. These screw shafts 16, 17 are supported rotatable but not movable in back/forth direction by means of flanges 35, 36 at a required position of said device body 1, while their rear ends being protruded to the outside. A driver groove 10 is equipped at the protruded end of this zero point adjusting screw shaft 16. The top of fine adjusting screw shaft 17 is protruded outside mounting plate 37 that is fixed in the front face of device body 1, through a penetration hole 38. A manual rotation knob 39 is fixed onto this protruded end, in a non-rotatable manner. A circular indication disk 40 is non-rotatable fixed onto the outer cutaway fringe of said penetration hole 38. A dial scale 41 is superposed rotatably on said indication disk 40. A short tube 42, surrounding fine adjusting screw shaft 17, is rotatably inserted through the center holes of these indication disk 40 and scale disk 41 and penetration hole 38. Scale disk 41 is fixed non-rotatably at the outer end of this short tube 42. The inner end of short tube 42 is protruded inside mounting plate 37 while integratedly mounting a force bearing gear 43 at said protruded end. An input gear 44 is fixed rotatably at a position inner than force bearing gear 43, on fine adjusting screw shaft 17. A reduction gear 47, comprising a large-diameter gear 45 and a small-diameter gear 46, is engaged with these input gear 44 and force bearing gear 43. Thereby, one turn of fine adjusting screw shaft 17 is transmitted to scale disk as one specified turn.

With this embodiment of the ink pot device, fine adjusting screw shaft 17 moves forwardly when knob 39 is forwardly rotated, while swinging link 22 forwardly. Thereby, eccentric cam 28 is slightly rotated moving an ink key 8 forwardly. When knob 39 is reversely rotated, ink key 8 is moved backwardly. The rotation of fine adjusting screw shaft 17, caused by rotating knob 39, is transmitted to scale disk 41 through input gear 44, reduction gear 47, force bearing gear 43 and short tube 42. At that time, a specified fraction of rotating angle of knob 39 is transmitted to scale disk 41. More explicitly, assume a configuration where 10 turns of knob 39 brings on about 1 turn of the scale disk. Then rotation quantity of knob 39, namely the stroke (degree of opening) of ink key 8 is indication scale disk 41 in a magnification 10×. Therefore, more precise and correct reading is assured advantageously for controlling fine opening in better accuracy.

Figure 6:
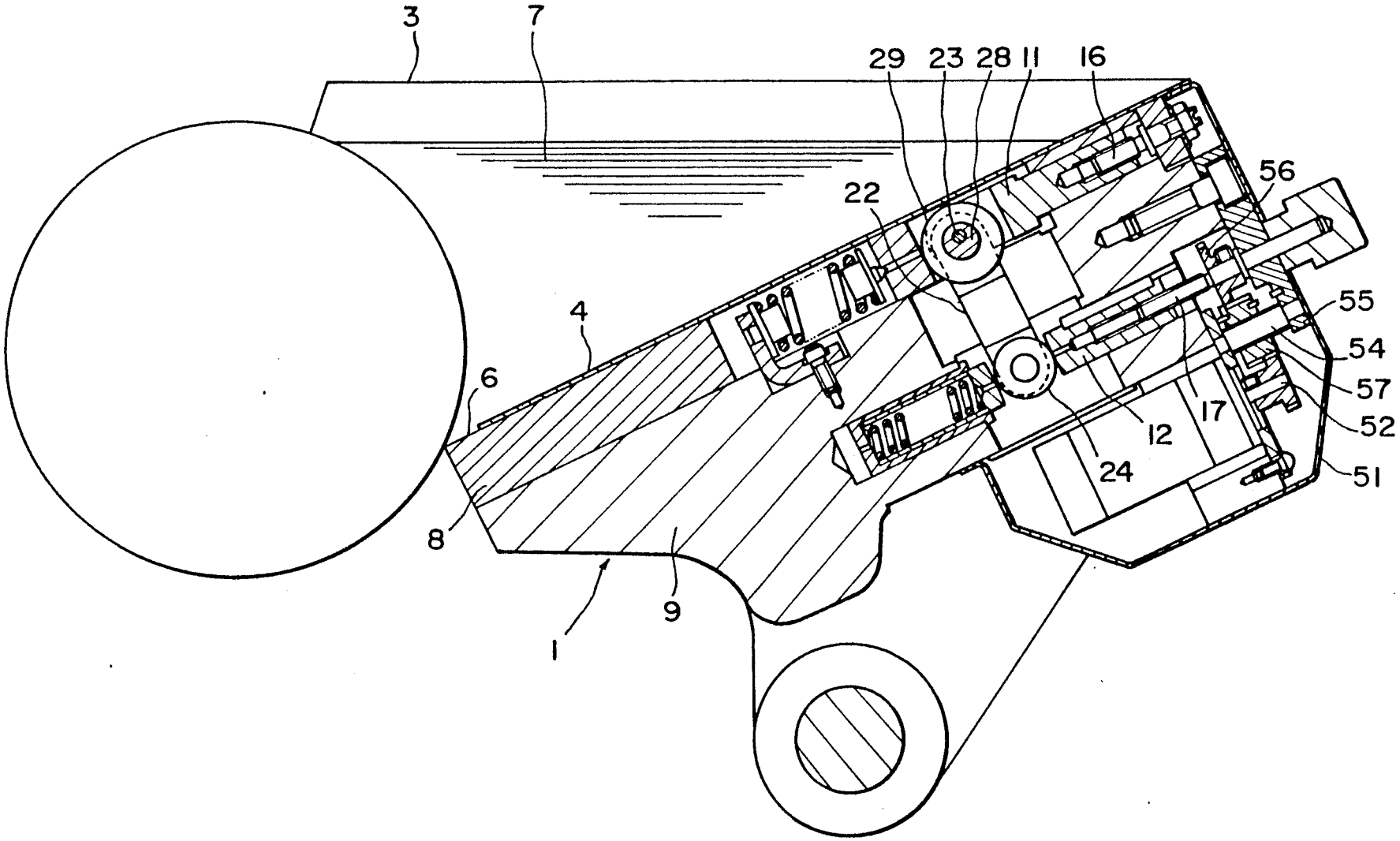
FIG. 6 shows a similar view to FIG. 2 for the ink pot device using stepping motors and rotary encoders based on the present invention.

FIG. 6 shows another embodiment of the present invention where the ink keys are electrically controlled in another format, similar to FIG. 2.

The basic configuration of this FIG. 6 is the same as FIG. 2, including the individual and mutual structures of fulcrum holder 11, adjust piece 12, link 22, ink keys 8, etc., which is not explained in the following paragraphs.

With this embodiment, a stepping motor 49 equipped with rotary encoder 48 coaxially arranged is provided for each ink key, to drive ink keys 8 in back/forth direction. A servoamplifier 50 for this stepping motor is also mounted at a necessary location.

More explicitly, a downward protrusion 51 is constructed under device body 1, on which stepping motor 49 is fixed. A driving pinion 53 is fixed non-rotatably on its rotating axis 52.

In detail, a downward protrusion 51 is provided under device body 1, onto which stepping motor 49 is fixed. A driving pinion 53 is secured non-rotatably onto its rotating axis 52.

In addition, an sub screw bolt 54 is spanned at an intermediate position between said fine adjusting screw shaft 17 and rotating axis 52, through stay 55.

A back/forth movable driving force transmission gear 57, machined with inner threads that engage with the threads of said sub screw volt 54, on its inner periphery and gear teeth that engage simultaneously with force bearing gear 56 and driving pinion 53 on its outer periphery, is mounted on said sub screw bolt 54.

High accuracy and high reliability can be assured with this embodiment while also simplifying the structure and mechanism (more compact) by the following reasons.

The following advantages are associated with the control using the stepping motor compared to conventional controls using the DC servomotor and potentiometer as known in the prior art.

(1) The stepping motor do not have contact part such as brush, different from the DC motor. In addition, the rotary encoder is also of non-contact type. Therefore, maintenance becomes easier while improving reliability.

(2) The lock current of the stepping motor (current value in stop condition) is increased by several tens % from the rated value. Therefore, overcurrent is applicable within a limited time to the motor. Consequently the control system is simplified in the zero adjustment, where all ink key stepping motors are simultaneously activated for a certain time and then the power is turned off. With a DC machine, on the other hand, lock current is several times as high as the rating, which prohibits continued current application. Therefore, the control system becomes more complicated, where the current must be limited by the current control circuit.

(3 ) Highly accurate and reliable ink key control is obtained because of a closed loop control using the rotary encoder.

(4) No coupling gear is required while simplifying and compacting the structure as the stepping motor is used together with the rotary encoder mounted on the driving shaft.

Figure 9:
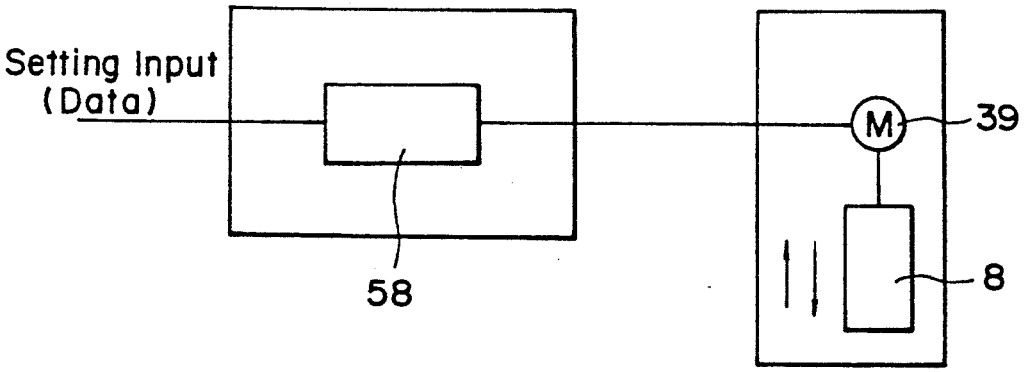
FIG. 9 illustrates the electric circuit diagram with the embodiment of FIG. 8.
Figure 8:
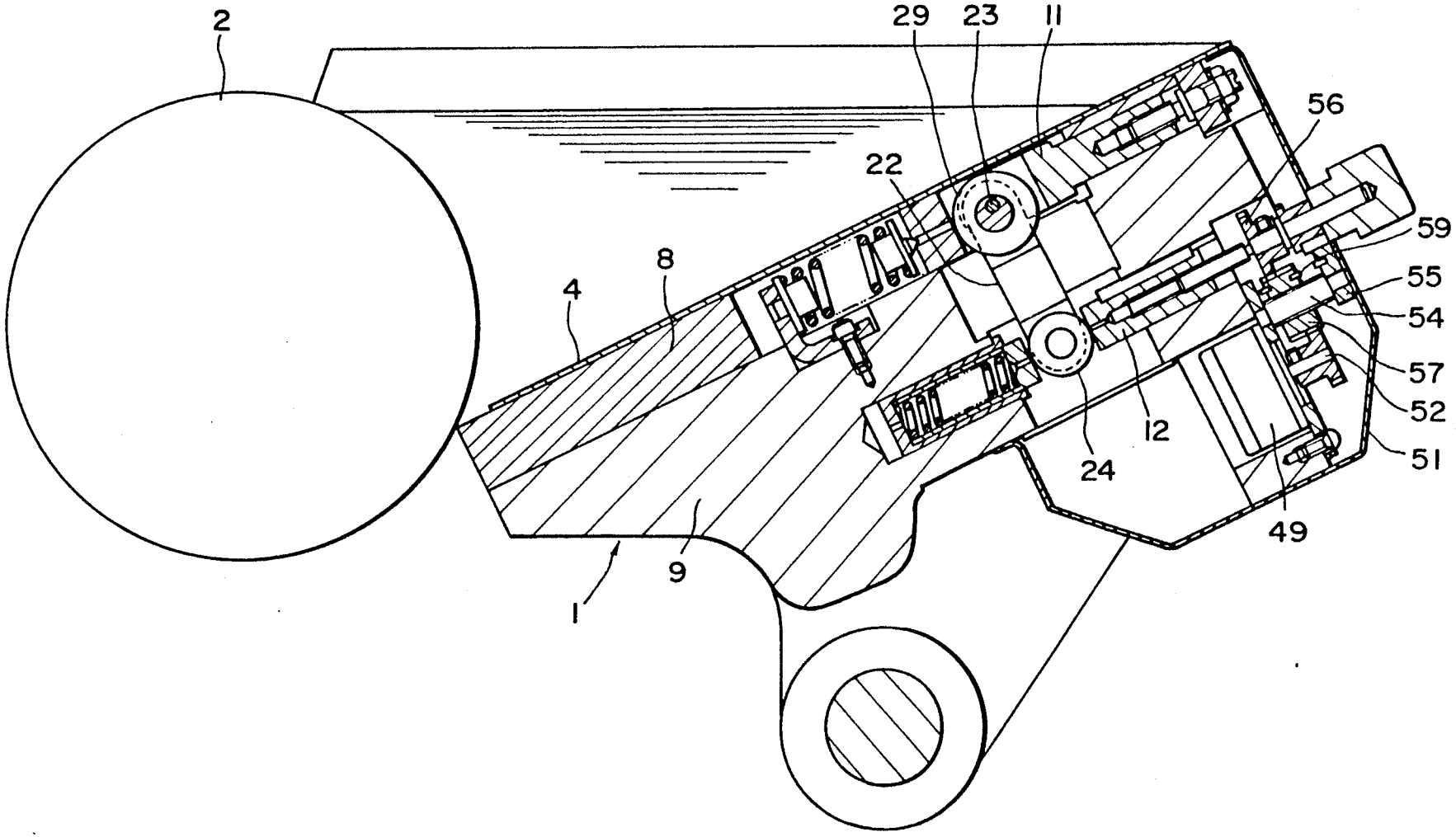
FIG. 8 is a similar view to FIG. 2 for the ink pot device using stepping motors based on the present invention.

FIG. 8 shows another embodiment of ink keys 8 based on the present invention, similar to FIG. 2, in which stepping motor 49 is used instead of the rotary encoder. FIG. 9 shows the electrical circuit diagram with the ink pot device in the embodiment of FIG. 8, in which 59 represents a data pulse conversion system.

An open loop control system is used with this embodiment, where a required number of pulses for necessary revolution frequency is given as a data.

The synchronous motor may also apply instead of the stepping motor. At that time, necessary frequency is given in place of the number of pulses in FIG. 9.

With the ink pot device of this embodiment using the stepping motor or the synchronous motor, all ink key adjusting stepping motors or synchronous motors are rotated for a certain time before setting the ink keys so that all ink keys are closed. This operation is to be carried out to have an agreement of zero points. With any ink key arriving at its zero point more early, its motor is stopped by the lower limit stopper means.

Where all ink keys are located at zero points, the stepping motor or the synchronous motor of each ink key is given the number of pulses or frequency proportional to respective data. The stepping motor or synchronous motor is rotated proportionally to this data, while completing the adjustment of ink supply rate. As such, the control system is operated in an open loop, which provides smaller and cheaper ink key adjusting device and control panel than those used in the prior art.

The ink pot device using the stepping motor or synchronous motor is applicable also to so-called piano keyboard system in which the front end of respective ink pot device is swung up and down instead of moving back and forth the ink pot device against the peripheral face of the gate roller.

FIGS. 8, 10–12 show another embodiment of the present invention.

Referring to FIGS. 8, 10–12, 49 represents the stepping motor while 57 showing a driving force transmission gear this driving force transmission gear 57 is supported back/forth movably on screw bolt 54 according to the revolution of said screw bolt 54. Driving force transmission gear 57 engages with force bearing gear 56 that is mounted at the rear end of fine adjusting screw shaft 17 engaged with adjust piece 12, where adjust piece 12 is moved through set gear and screw when the stepping motor rotates.

59 and 60 represent protrusions for engaging the upper and lower limits provided on said driving force transmission gears, respectively. 61 and 62 show stopper protrusions that engage and butt with said protrusions 59, 60. These are detailed in FIGS. 10–12.

Figure 10:
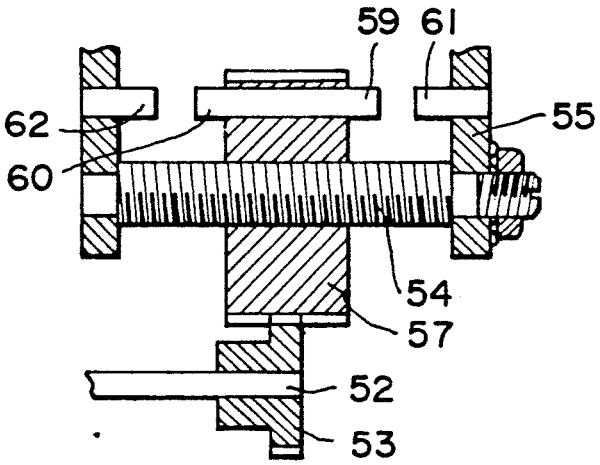
FIGS. 10–12 are sectional views for showing the stop position of the fine adjusting motor, activated by its driving gear, with the ink pot device according to the present invention.
Figure 11:
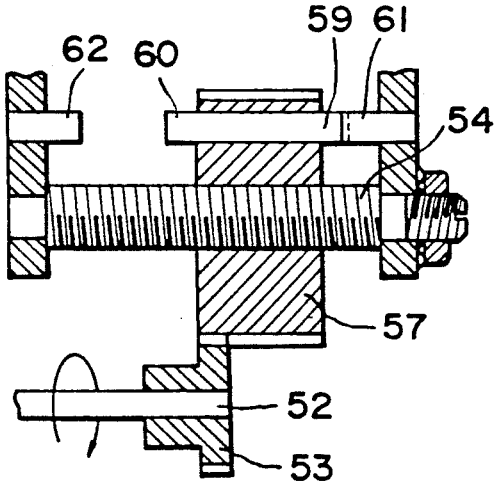
Figure 12:
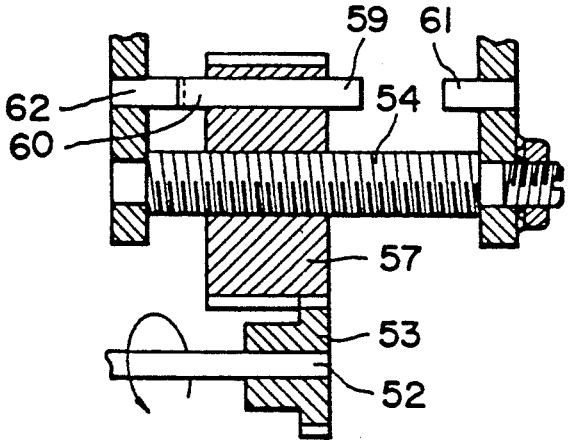

FIG. 10 shows a case where driving force transmission gear 57 is located at an intermediate position. FIG. 11 shows a state where driving force transmission gear 57 reached the upper limit position with its upper limit engagement protrusion 59 engaging and butting with upper limit stopper protrusion 61. In FIG. 12, driving force transmission gear 57 comes to the lower limit position while lower limit engagement protrusion 60 and lower limit stopper protrusion of driving force transmission gear 57 are engaged and butted.

When driving force transmission gear 57 begins to move to the right in FIG. 10 along with the rotation of driving pinion 53 and reaches the position shown in FIG. 11 namely the upper limit, upper limit engagement protrusion 59 engages with upper limit stopper protrusion 61 with driving force transmission gear 57 pressed by a counter force to the rotating direction of said transmission gear 57. Thereby, driving pinion 53, rotating axis 52 and stepping motor 49 are stopped. When driving pinion 53 rotates in the direction reverse to the foregoing rotating direction while said transmission gear 57 beginning to move to the left of FIG. 10 and reaching the position of FIG. 12 namely the lower limit, lower limit engagement protrusion 61 engages with lower limit stopper protrusion 62 thus stopping stepping motor 49.

With the ink pot device of this embodiment, all ink key adjusting stepping motors 49 are rotated for a certain time period before ink keys 8 are set, so that ink keys 8 are closed. Thereby, when any ink key 8 reaches the zero point more early, motor 49 is stopped by lower limit stopper protrusion 62. Where all ink keys 8 are located at zero points, stepping motor 49 of each ink key 8 is given the number of pulses, proportional to respective data. Stepping motor 49 is then rotated by a quantity proportional to this number of pulses, thus the adjustment of ink supply rates is completed.

With the ink pot device of this embodiment, the ink keys are moved forwardly and backwardly in the direction to the peripheral face of the gate roller. Therefore, this ink pot device is applicable to an ink pot device for the so-called piano keyboard type printing machine, where the front end of each ink key is swung up and down. In addition, it is also applicable to an ink pot device for such a type of printing machine, where the open fringe of the ink catch bottom plate is swung by the pushing an releasing of an ink rate adjusting screw that moves forwardly and backwardly.

Figure 13:
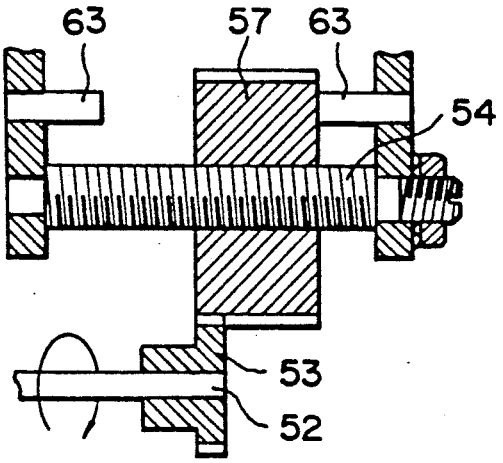
FIG. 13 PRIOR ART
FIG. 13 is a sectional view for illustrating the stop position of the fine adjusting motor, activated by driving gear, with the ink pot device based on the prior art.

The ink pot device of this embodiment is completely free from engagement phenomena that used to occur with the ink pot devices known in the prior art as shown in FIG. 13. More explicitly, it completely does not occur that the inner screw in the driving force transmission gear adversely engages with the screw of the screw bolt. Consequently, the reciprocating motion of the driving force transmission gear is conducted very smoothly without any offset of stop position.

Figure 14:
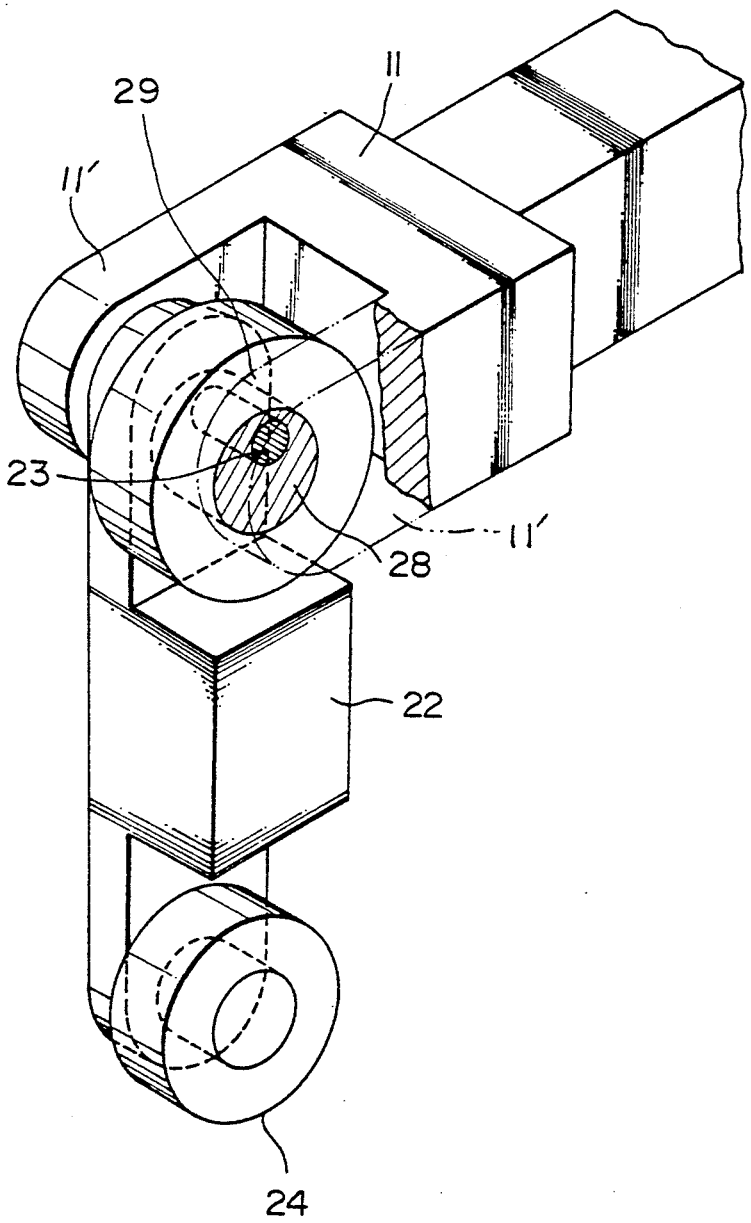
FIG. 14 is a partial cutaway perspective view showing a holding means (11) for movably holding a pivot shaft pivotally supporting said adjusting link as well as an eccentric means.

FIG. 14 shows still another embodiment of the present invention. In this embodiment, the fulcrum holder 11 is in the form of a slidable bar. The bar includes a pair of parallel arms 11',11' at its front edge. Supported between the arms 11',11' are fulcrum axis 23, eccentric 28, floating ring 29 and the fixed end of link 22, as is shown i FIG. 14. A zero point adjusting screw shaft 16 (not shown) is screwed into the rear part of the slidable bar 11 for moving the bar forwardly and backwardly.

What is claimed is:

1. In an ink pot device of the divided ink key blades type comprising an ink gate roller having a peripheral face, a body, a plurality of ink keys, each ink key of said ink keys having a front end adjacent to said peripheral face and a rear end; links, each link of said links being associated with a respective ink key and having one end which is pivotally supported by a pivot shaft behind said respective said ink key; individual eccentric means associated with and connected to a respective said link, each eccentric means being fixedly mounted on the pivot shaft and moveably together with said respective link and being in constant contact with the rear end of a respective said ink key, and means for swinging each respective link by acting on the other end thereof so that, by swinging each respective link to shift the eccentric means, the distance between the front end of each respective ink key and the peripheral face of the ink gate roller may be changed to adjust the amount of ink supplied onto the ink gate roller; the improvements which comprises:

a means for moveably holding the pivot shaft of each respective link in the moving direction of each respective ink key, and a means for shifting the holding means, so that each respective ink key may be shifted independently of the means for swinging each respective link, thereby changing the distance between the front end of each respective ink key and the peripheral face of the ink gate roller.

2. An ink pot device of the divided ink key blades type according to claim 1, wherein the means for moveably holding the pivot shaft of each respective link a slidable bar which holds the pivot shaft, said bar having a front part and a rear part and having a pair of parallel arms, and the mans for shifting the holding means is a screw shaft which is threaded in the rear part of the slidable bar and is unshiftably supported in the axial direction thereof and with respect to the body of the ink pot device.

3. An ink pot device according to claim 1 further characterized in that the means for moveably holding the pivot shaft of each respective link in the moving direction of each respective ink key is a fulcrum folder;

the eccentric means is an eccentric cam having a cam surface, and the means for swinging each respective link by acting on said other end thereof is a respective adjust piece associated with a respective ink key and equipped under said fulcrum holder.

4. An ink pot device as defined in claim 3, further comprising:

a pushing means that always pushes the rear end of each respective ink key onto the cam surface of said eccentric cam, a zero point adjusting screw shaft device that is provided with means for driving said fulcrum holder to move forwardly and backwardly, and a fine adjusting screw shaft device that is provided with means for driving each respective adjust piece to move forwardly and backwardly.

5. An ink pot device as defined in claim 4 wherein each respective adjust piece associated with each respective ink key is coupled to an associated stepping motor that is controlled in a closed loop and provided with a coaxially arranged rotary encoder as a forward-/backward driving device for each respective ink key.

6. An ink pot device as defined in claim 2 wherein each respective adjust piece associated with each respective ink key is coupled to an associated stepping motor that is provided for each respective ink key as an ink key forward/backward driving device.

7. An ink pot device as defined in claim 4 wherein each respective adjust piece associated with each respective ink key is coupled to an associated synchronous motor that is provided for each ink key as an ink key forward/backward driving device.

8. An ink pot device as defined in claim 4 wherein said means for driving said fulcrum holder further comprises a manual rotation knob coupled to said zero point adjusting screw shaft.

9. An ink pot device as defined in claim 4 wherein said means for driving the adjust piece further comprises a manual rotation knob coupled to said fine adjusting screw shaft, said rotation knob further including a counter.

* * * * *